United States Patent [19]

Palm

[11] 4,389,152

[45] Jun. 21, 1983

[54] STIFFLEG CONSTRUCTION FOR POWER SHOVELS

[75] Inventor: Michael M. Palm, Marion, Ohio

[73] Assignee: Dresser Industries, Inc., Dallas, Tex.

[21] Appl. No.: 297,989

[22] Filed: Aug. 31, 1981

Related U.S. Application Data

[63] Continuation of Ser. No. 186,850, Sep. 15, 1980, abandoned, which is a continuation of Ser. No. 950,006, Oct. 5, 1978, abandoned.

[51] Int. Cl.[3] ..... B66C 23/00; E02 3/62

[52] U.S. Cl. ..... 414/694; 212/144

[58] Field of Search ..... 414/722, 727, 694; 212/144; 52/729, 116, 117, 118

[56] References Cited

U.S. PATENT DOCUMENTS

| | | | |
|---|---|---|---|
| 1,739,952 | 12/1929 | Downie | 212/144 X |
| 3,501,034 | 3/1970 | Baron | 414/694 |
| 3,527,362 | 9/1970 | Allen | 212/144 X |
| 3,648,863 | 3/1972 | Baron et al. | 414/694 |
| 3,722,864 | 3/1973 | Borer et al. | 414/727 X |
| 4,134,507 | 1/1979 | Piercy et al. | 212/144 |

*Primary Examiner*—John J. Love
*Assistant Examiner*—L. E. Williams
*Attorney, Agent, or Firm*—Gerald L. Lett

[57] ABSTRACT

A stiffleg for a power shovel generally consisting of a pair of transversely spaced, longitudinally disposed side beams each having an I-shaped cross-sectional configuration including upper and lower flange portions and an interconnecting web portion, a cross-piece section interconnecting said side beam sections and a web section interconnecting the web portions of said side beam sections, apparatus for operatively connecting one end thereof to a support unit and apparatus for operatively connecting a dipper handle thereto.

7 Claims, 4 Drawing Figures

STIFFLEG CONSTRUCTION FOR POWER SHOVELS

This is a continuation of application Ser. No. 186,850, filed Sept. 15, 1980, abandoned which is a continuation of application Ser. No. 950,006, filed Oct. 5, 1978 now abandoned.

This invention relates to power shovels and more particularly to a novel stiffleg construction for a power shovel.

In conventional power shovels, there normally is provided a support unit, a stiffleg operatively connected to the support unit, a dipper handle operatively connected to the stiffleg, a dipper mounted on the dipper handle and means for crowding, retracting and hoisting the dipper. Operating loads applied to the dipper from various directions are transmitted through the dipper handle and stiffleg to the main frame of the support unit. Torsional loads imposed on the stiffleg are counteracted by the use of resilient joints provided either on the handle or the stiffleg which function to cushion such loads thus dissipating or otherwise mitigating the adverse effects of such loads.

The use of resilient joints on either the dipper handle or stiffleg of a power shovel has several disadvantages. The use of such joints increases the original cost of the machine and possibly the repair and maintenance costs of the equipment. In addition, the use of such joints on the dipper handle or stiffleg increases the weight of the front end assembly of the machine, requiring increased horsepower to operate the machine, thereby reducing its operating efficiency. Because of such undesirable aspects in the use of resilient joints, it has been desirable to provide an improved means for counteracting the adverse effects of torsional loads applied to the front end assemblies of power shovels.

Accordingly, it is the principal object of the present invention to provide an improved means for counteracting the detrimental effects of torsional loads applied to the front end assembly of a power shovel.

Another object of the present invention is to provide an improved means for counteracting the detrimental effects of torsional loads applied to the front end assembly of a large, heavy-duty mining shovel.

a further object of the present invention is to provide an improved means for counteracting the detrimental effects of torsional loads applied to the front end assembly of a power shovel which will not result in an increase in the original, repair or maintenance costs of the front end assembly of the machine.

Another object of the present invention is to provide an improved means for counteracting the torsional loads applied to the front end assembly of a power shovel without increasing the weight of the front end assembly.

A further object of the present invention is to provide an improved stiffleg for a power shovel.

A still further object of the present invention is to provide an improved stiffleg for a power shovel which is adapted to carry torsional loads applied to the front end assembly of the shovel during normal operating conditions, without incurring unduly high stresses.

Another object of the present invention is to provide a novel stiffleg for a power shovel which is comparatively simple in design, relatively inexpensive to manufacture and highly effective in performance.

Other objects and advantages of the present invention will become more apparent to those persons having ordinary skill in the art to which the present invention pertains, from the following description, taken in conjunction with the accompanying drawings wherein.

Figure 1:
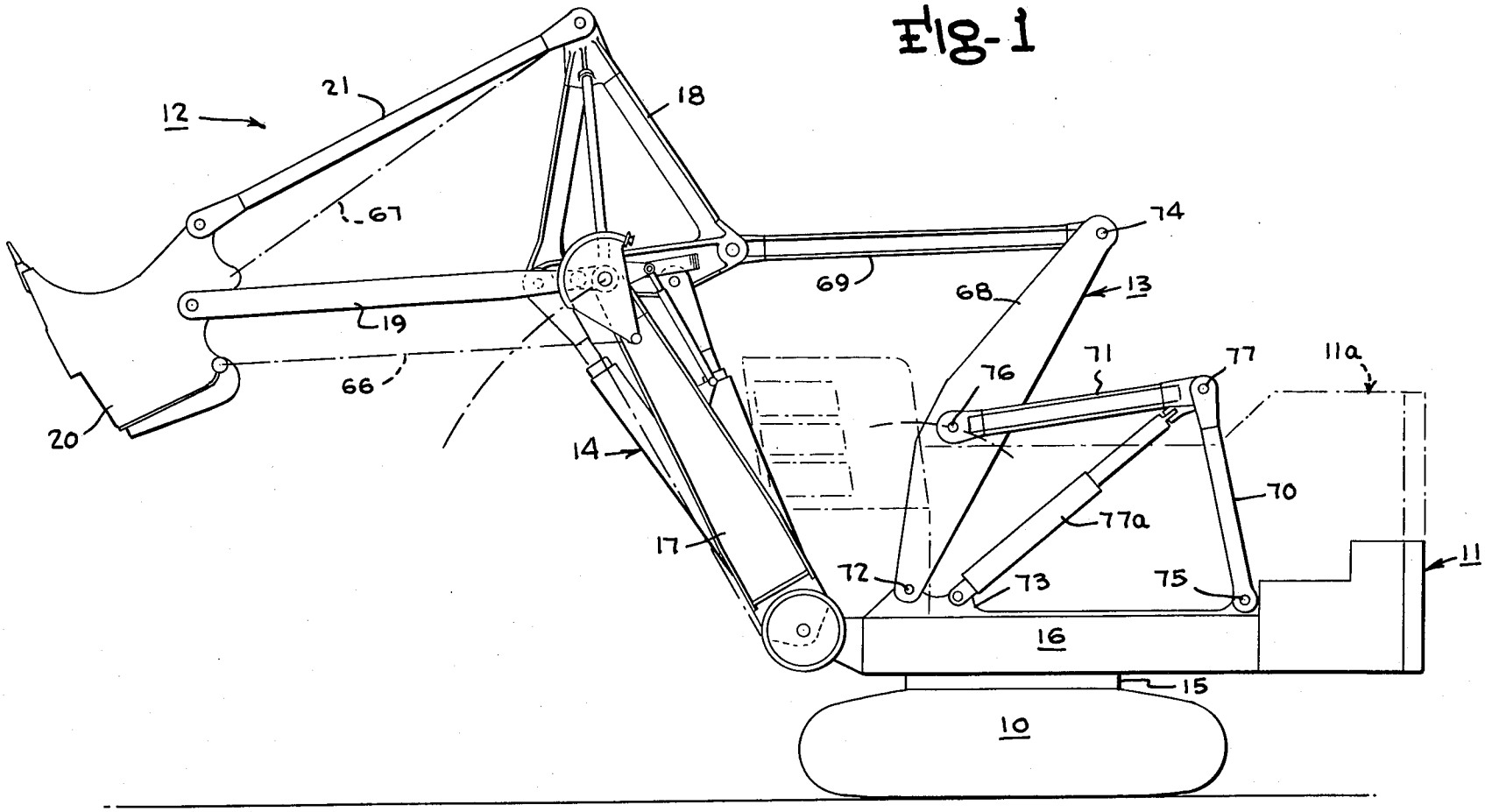
FIG. 1 is a side elevational view of a power shovel utilizing the present invention.

Referring to the drawings, there is illustrated an embodiment of the invention which generally includes a crawler unit 10, a main support unit 11 mounted on the crawler unit, a front end assembly 12 mounted on the front end of the main support unit, a crowd system 13 mounted on the main support unit and operatively connected to the front end assembly, a hoist system 14 mounted on the front end assembly, and a system mounted on the main support unit for operating the crowd and hoist systems.

Crawler unit 10 consists of a lower frame supported on a pair of conventional crawler assemblies, and a conventional roller circle 15 mounted on the lower frame. Main support unit 11 consists of an upper frame 16 rotatably mounted on the roller circle and a housing 11*a* mounted on the upper frame, which encloses certain components of the housing structure, the crowd system, the swing and propulsion machinery and other auxiliary systems and equipment.

Figure 2:
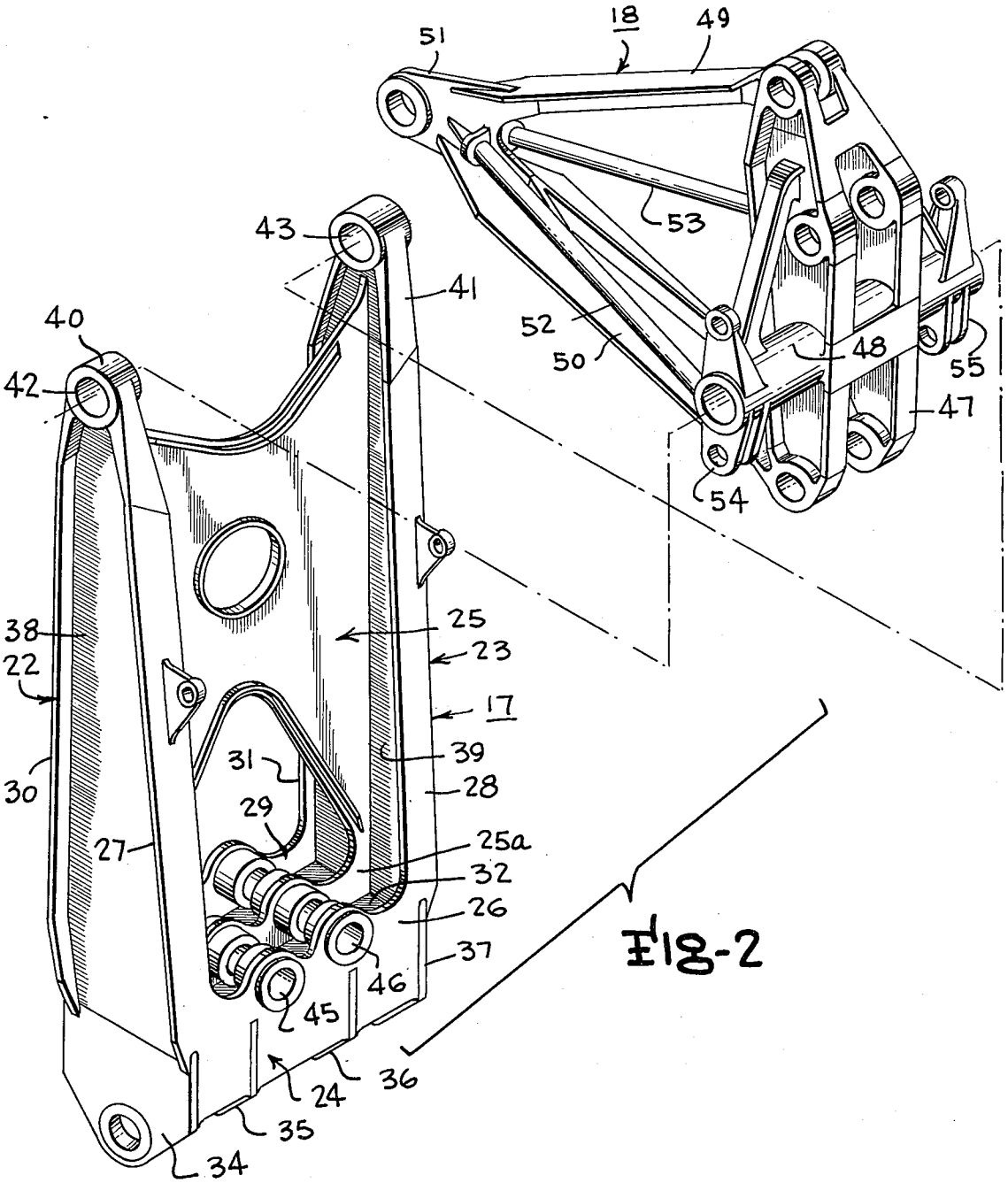
FIG. 2 is an enlarged, perspective view of a stiffleg embodying the present invention and a hoist frame used with the invention, both components comprising portions of the front end assembly shown in FIG. 1.
Figure 3:
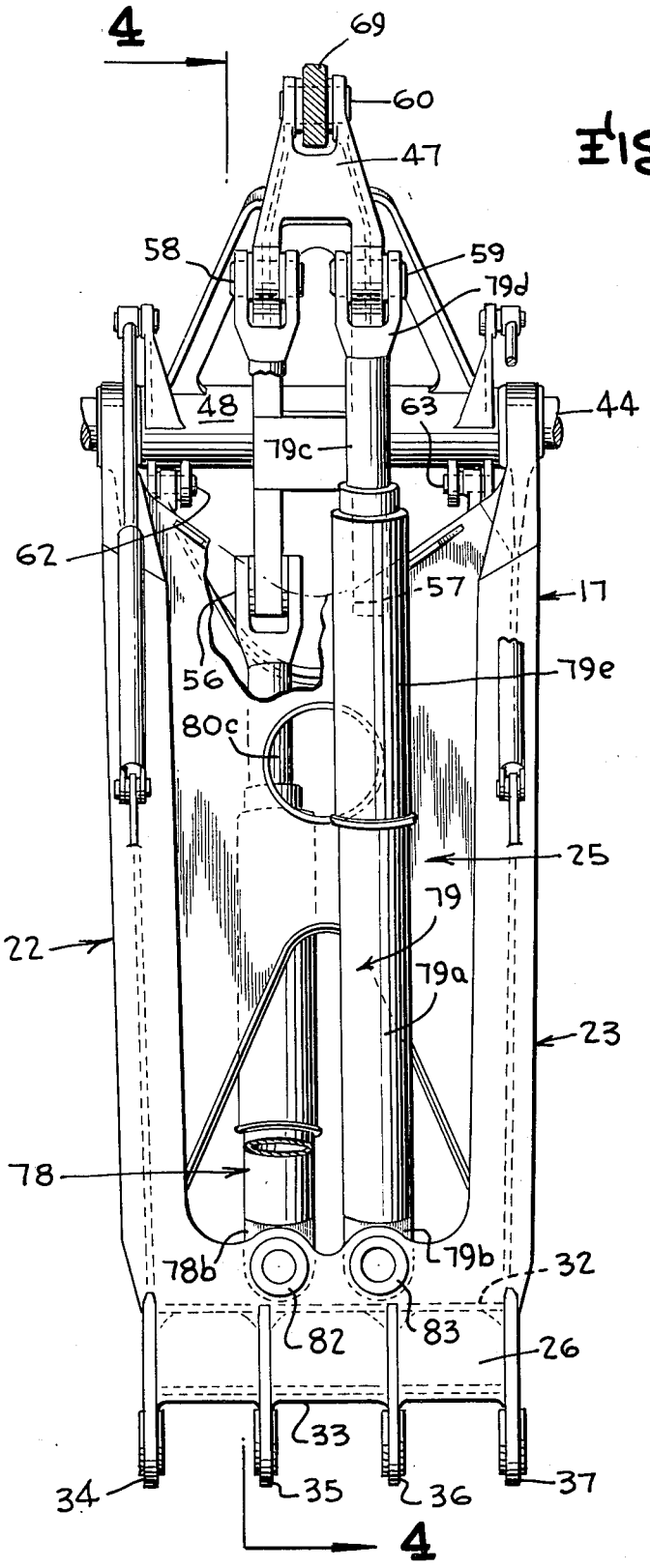
FIG. 3 is an enlarged view of the stiffleg and hoist frame shown in FIG. 1.

Front end assembly 14 generally includes a stiffleg 17, a hoist frame 18, a dipper handle 19, a dipper 20 and a hoist link 21. As best illustrated in FIGS. 2 and 3, the stiffleg consists of a pair of transversely spaced, longitudinally disposed I-beam sections 22 and 23 joined together at their lower ends by a transversely disposed box beam section 24, forming a U-shaped structure, and a web section 25 interconnecting the I-beam sections above box beam section 24. Section 24 is provided with an upper plate member 26 which merges with upper flange portions 27 and 28 of I-beam sections 22 and 23, a lower plate member 29 which merges with lower flange portions 30 and 31 of I-beam sections 22 and 23, a front plate member 32 and a rear plate member 33. Formed integrally with box beam section 24 is a plurality of mounting brackets 34 through 37, provided with axially-aligned openings, for pin mounting the foot of the stiffleg on the front end of the upper frame of the machine.

Web portions 38 and 39 of I-beam sections 22 and 23 are disposed substantially in longitudinal alignment with outer mounting brackets 34 and 37. The web portions also are interconnected by web section 25. The upper ends of the I-beam sections are formed with end portions 40 and 41 in which there are provided axially-aligned openings 42 and 43 in which bearings are mounted for journalling a head shaft 44.

The forward ends of plate members 26 and 29 and web portion 25*a* are formed with two sets of bosses providing two sets of pin-receiving openings 45 and 46. As best illustrated in FIG. 3, it will be noted that the axes of pin-receiving openings 45 and 46 lie substantially in the same vertical planes as mounting brackets 35 and 36, respectively.

As best seen in FIG. 2, hoist frame 18 includes a bifurcated base section 47, a cylindrical mounting section 48 disposed intermediate the ends of and formed integrally with base section 47, a pair of upper and lower converging struts 49 and 50 formed integral at one set of ends thereof with the upper and lower ends of base section 47 and formed integrally at an opposite set of ends thereof with a head section 51, and a pair of struts 52 and 53 connected at a rearward set of ends thereof with the outer ends of cylindrical mounting section 48 and connected at a forward set of ends thereof with head section 51. The outer ends of mounting member 48 also are provided with depending sets of lugs 54 and 55.

Figure 4:
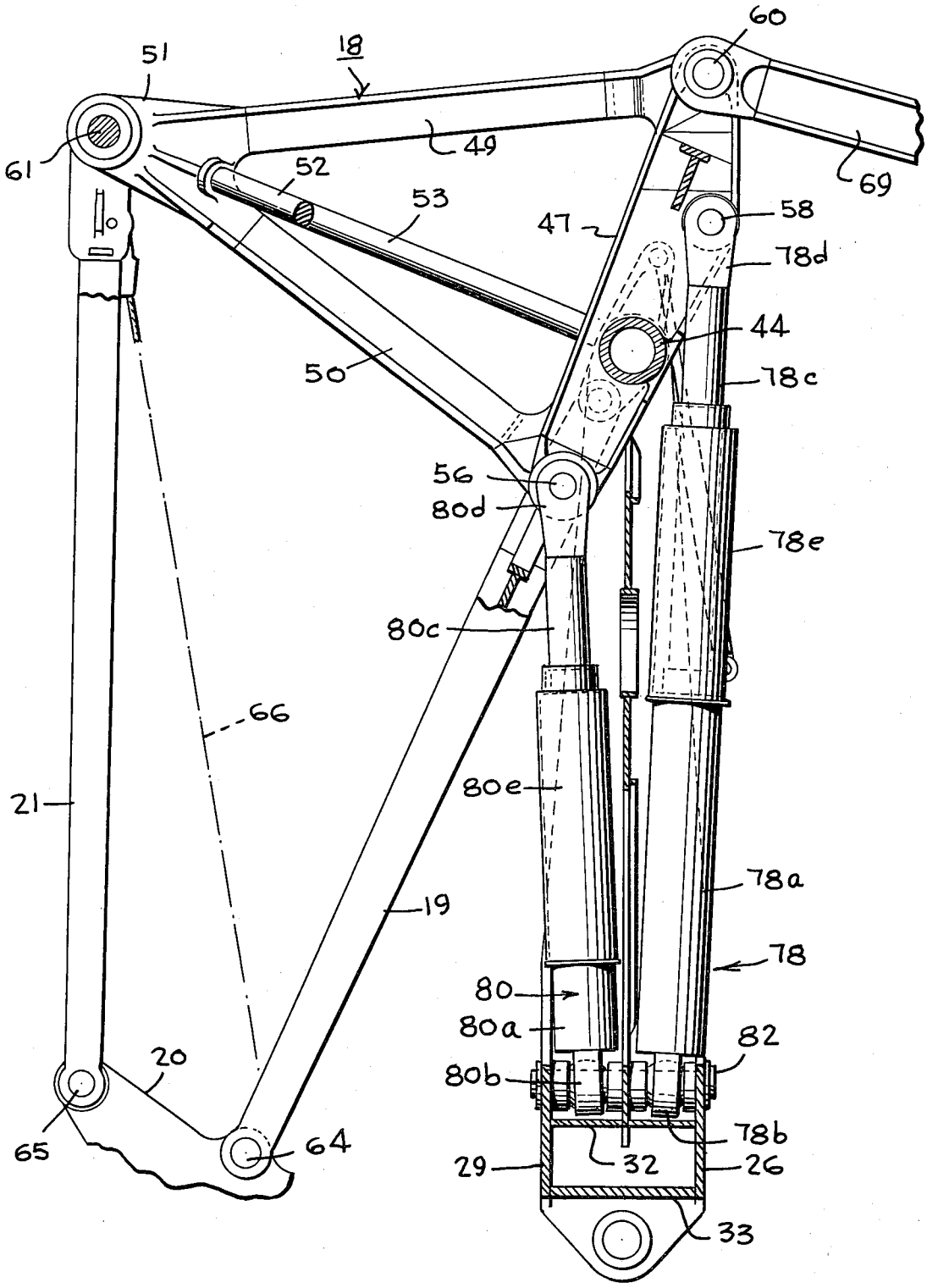
FIG. 4 is a cross-sectional view taken along line 4—4 in FIG. 3.

Hoist frame 18 is pivotally connected to the upper end of stiffleg 17 by means of head shaft 44 which is received in mounting section 48 and journalled at its ends in bearings provided in aligned openings 42 and 43 in the upper end of the stiffleg. As best shown in FIGS. 2, 3 and 4, the lower end of bifurcated base section 47 is formed with a pair of aligned openings provided with a pair of connecting pins 56 and 57. The upper portion of section 47, between mounting section 48 and the upper end of section 47, is formed with a pair of aligned openings provided with a set of connecting pins 58 and 59.

The upper end of base section 47 is provided with a bifurcated configuration having a pair of aligned openings for receiving a connecting pin 60. Head section 51 is provided with an opening for mounting a bearing for a connecting pin 61. The hoist frame further is provided with aligned openings in depending sets of lugs 54 and 55 which are provided with connecting pins 62 and 63.

Handle 19 consists of a suitable structural member and is provided with upper and lower bifurcated ends. The upper bifurcated end is connected to the hoist frame by means of pins 62 and 63, as best shown in FIG. 3. It will be noted that the axis of pins 62 and 63 is displaced radially relative to the axis of head shaft 44 so that the pivot axis of the handle relative to the hoist frame is displaced radially relative to the pivot axis of the hoist frame relative to the stiffleg. Such arrangement alleviates a congestion of components on the head shaft and reduces the bending forces on the head shaft, as is more fully described in U.S. Pat. No. 3,856,161. The lower bifurcated end of the handle is pivotally connected to the upper rear end of dipper 20 by means of a pair of axially aligned pins 64.

Head section 51 of the hoist frame and the upper front end of dipper 20 are connected by hoist link 21. The upper end of the hoist link is bifurcated and connected to the head section of the hoist frame by means of connecting pin 61. The lower bifurcated end of the hoist link is connected to the dipper by means of a pair of axially aligned pins 65. As best illustrated in FIGS. 1 and 4, hoist frame 18, handle 19, dipper 20 and hoist link 21 are pivotally connected together to provide a four-bar linkage with the link comprising the hoist frame being pivotally connected to the upper end of the stiffleg by means of head shaft 44.

To provide a substantially flat pass of the dipper when it is crowded into a bank of material being excavated or loaded, there is mounted on the front end assembly a pitch control system 66, the construction and operation of which is fully described in U.S. Pat. Nos. 3,501,034 and 3,648,863. In addition, the front end assembly is provided with a pitch stop assembly 67, the construction and operation of which is fully described in U.S. Pat. No. 4,085,854.

The construction and operation of crowd system 13 is fully described in U.S. Pat. No. 4,046,270. Generally, it consists of a linkage arrangement and a fluid actuated system. Referring to FIG. 1, the linkage includes a mast 68, a connecting link 69, a pair of transversely spaced support links 70 and a pair of transversely spaced crowd drive links 71. Mast 68 consists of a pair of transversely spaced side sections pivotally connected at their lower ends by means of connecting pins 72 to mounting brackets 73 rigidly secured to the deck of upper frame unit 16, forwardly of the vertical center line of rotation of the upper frame, and cross-piece sections interconnecting the side sections between the upper and lower ends thereof. The forward end of connecting link 69 is pivotally connected to the upper end of hoist frame 18 by means of connecting pin 60. The rearward end of such link is connected to the upper end of mast 68 by means of a connecting pin 74. Support links 70 are pivotally connected at their lower ends to brackets rigidly secured to the deck of the upper frame unit by means of pins 75. The front ends of crowd drive links 69 are connected to mast 68 by means of connecting pins 76. The rear ends thereof are connected to the upper ends of support links 70 by means of pins 77 to provide a four-bar linkage arrangement consisting of the upper frame unit, the lower end of mast 68 crowd drive links 71 and support links 70.

Pivotally connected at their lower ends of the deck of the upper frame adjacent the lower end of mast 68 and pivotally connected at their upper ends to connecting pins 77 is a pair of fluid actuated rod and cylinder assemblies **77*a* which constitute components of the fluid actuating system. It will be appreciated that upon supplying fluid under pressure to opposite ends of the fluid actuated assemblies, the rods thereof will be extended and retracted to pivot support links 70 in vertical planes. The motion of support links 70 correspondingly will be transmitted through crowd drive links 71, mast 68 and connecting link 69** to the front end assembly of the machine consisting of the stiffleg, hoist frame, handle, dipper and hoist link to correspondingly crowd and retract the dipper.

Hoist system 14 consists of a pair of pull-type, hydraulically actuated rod and cylinder assemblies 78 and 79 operatively interconnecting the lower end of the stiffleg and an upper side of the hoist frame, a pair of push-type, hydraulically actuated rod and cylinder assemblies 80 and 81 (hidden behind assembly 80 in FIG. 4) operatively interconnecting the lower end of the stiffleg and a lower side of the hoist frame, and a suitable fluid supply system for supplying fluid under pressure to the cylinders of the assemblies. Assemblies 78 and 79 are substantially similar in construction, and assemblies 80 and 81 also are substantially similar in construction. Assembly 78 is provided with a cylinder portion **78*a* having a mounting fixture 78*b* on the free end thereof, a rod 78*c* slidably mounted in cylinder portion 78*a*, in the conventional manner, having a mounting fixture 78*d* mounted on the free end thereof, and a dust shield 78*e* mounted on the exposed end of rod portion 78*c*. Generally, dust shield 78*e* includes an annular end portion secured to the exposed end of rod portion 78*c* and a cylindrical portion secured to the annular portion thereof. The cylindrical portion of the dust shield has a length sufficient to overlie the juncture of the exposed portion of the rod and the cylinder for the full range of displacement of the rod relative to the cylinder so that during normal operation of the assembly, the dust shield will shield such juncture from the environment thus preventing contaminants from lodging on the rod and being carried into the cylinder. To further assure against the entry of contaminants between the dust shield and the cylinder, pressurized air may be injected into the dust shield which would be ejected through the annular space between the shield and the cylinder portion of the assembly, forming a pneumatic seal therebetween. Similarly, assembly 79 includes a cylinder portion 79***a* having a mounting fixture 79*b* mounted on the free end thereof, a rod portion 79*c* having a mounting fixture 79*d* mounted on the free end thereof and a dust shield 79*e* which functions in the same manner as dust shield 78*e*.

Actuating assemblies 78 and 79 are mounted on the upper side of stiffleg 17, between beam sections 22 and 23. The lower ends thereof are pivotally connected to section 26 of the stiffleg by means of mounting pins 82 and 83 mounted in the bosses provided in section 26. As shown in FIG. 4, connecting pins 82 and 83 are provided with spherical bushings to permit limited universal movement of the lower ends of the actuating assemblies 78 and 79 relative to the connecting pins and the lower end of the stiffleg. The upper ends of the assemblies are pivotally connected to the hoist frame by means of connecting pins 58 and 59.

Actuating assemblies 80 and 81 also are similar in construction. Assembly 80 consists of a cylinder portion 80*a* having a mounting fixture 80*b* mounted on the free end thereof, a rod portion 80*c* having a mounting fixture 80*d* mounted on the free end thereof and a dust shield 80*e*. Assemblies 80 and 81 are mounted on the underside of the stiffleg, between beam sections 22 and 23. The lower ends of the assemblies are universally mounted on spherical bushings provided on connecting pins 82 and 83, and the upper ends thereof are connected to connecting pins 56 and 57 mounted at the lower end of base section 47 of the hoist frame.

Actuating assemblies 78 through 81 are of a single-acting type. The fluid supply system forming part of the hoist system can be of any suitable type which simultaneously will provide fluid under pressure to the cylinder ends of push-type assemblies 80 and 81 and to the rod ends of pull-type assemblies 78 and 79 to effect a hoisting motion of the dipper. It will be appreciated that by supplying fluid under pressure to the cylinder ends of assemblies 80 and 81 and to the rod ends of assemblies 78 and 79, rods 80*c* and 81*c* will be caused to extend and rods 78*c* and 79*c* will be caused to retract to pivot the hoist frame and correspondingly the handle, dipper and hoist link about the axis of the head shaft to effect the hoist motion. While the embodiment described herein utilizes a combination of two equally-sized pull-type assemblies mounted on the upper side of the stiffleg and two equally-sized push-type cylinders mounted on the underside of the stiffleg to effect the hoisting motion, it is to be understood that any combination of numbers and sizes of cylinders can be used to provide the desired hoisting motion.

At the beginning of each digging cycle of the machine as described, the crowd system is operated to fully retract the front end assembly and the hoist system is operated to lower the dipper so that the dipper is positioned adjacent the lower end of the stiffleg. Suitable resilient pads are provided at the lower end of the stiffleg to prevent damage to the stiffleg by the dipper. To commence the operating cycle of the machine, the operator manipulates appropriate controls at the operator's station on the machine to permit fluid to flow from the cylinder ends of actuating assemblies 77*a* of the crowd system. Under such conditions, the weight of the front end assembly will cause the stiffleg to pivot forwardly, simultaneously crowding the dipper into the material being excavated or loaded. Simultaneously with the commencement of the crowding action of the dipper, appropriate controls are operated on the machine to effect limited hoisting motion of the dipper. This is accomplished by supplying fluid under pressure to the cylinder ends of push-type assemblies 80 and 81 of the hoist system and to the rod ends of pull-type cylinders 78 and 79. As the dipper is crowded into the bank of material being excavated or loaded, the combined crowding and hoisting action causes it to make a flat pass. At the same time, pitch control system 66 causes the pitch of the dipper to remain constant relative to the ground. At the end of the crowd phase of the cycle, the pitch control mechanism is released to cause the dipper to pitch upwardly and thus assure a full load of material in the dipper. The upward pitch of the dipper is restricted by pitch control system 67 in a manner as described in the aforementioned patent relating to such system.

After the dipper has been pitched upwardly, controls for the crowd and hoist systems and swing machinery are operated to position the dipper above the dump body of a hauling vehicle or another suitable repository for the material, where the door of the dipper is tripped to cause the door to open and the material to be unloaded. The desired retracting motion of the front end assembly is effected by supplying fluid under pressure to the cylinder ends of actuating cylinders 77*a* of the crowd system. Such action results in the extension of the rods of such assemblies to pivot the support links 70 rearwardly, simultaneously causing the front end to pivot rearwardly about the pivotal connection of the stiffleg to the upper frame of the machine. Accelerated hoisting motion is effected by increasing the flow of fluid to the cylinder ends of actuating assemblies 80 and 81 and the rod ends of actuating assemblies 78 and 79.

As soon as the material has been dumped, the swing machinery can be operated to rotate the front end of the machine back to the embankment, the crowd system can be operated to continue to retract the front end assembly and the fluid under pressure supplied to the hoist cylinders can be throttled down to permit the dipper handle to swing downwardly at a controlled rate until it again is positioned at the lower end of the stiffleg, ready to begin another operating cycle.

During the operating cycle of the machine as described, loads in tension, compression and bending imposed upon the dipper are transmitted through the dipper handle, the base portion of the hoist frame, the head shaft, the stiffleg and the foot pins into the upper frame of the machine. Asymmetric loads imposed on the dipper as when the full lip of the dipper may not be engaging the material being penetrated, are translated through the dipper handle and stiffleg as torsional loads relative to the center lines of the dipper handle and stiffleg. The major contributor of torsion in the stiffleg is due to side loads on the dipper (perpendicular to the line of action) brought about by sweeping and encountering a large object while rotating the machine, or due to a bank configuration which would force the dipper to one side. Such torsional loads are carried by the deflection or limbering action of the stiffleg thus diminishing, if not entirely eliminating, the transmission of such loads to the upper frame of the machine. Horizontal loads imposed on the front end assembly are resisted by web section 25 interconnecting the I-beam sections of the stiffleg.

The construction of the stiffleg particularly is well suited for carrying torsional loads imposed on the machine during the crowding phase of the digging cycle. Under torsional load, one I-beam section of the stiffleg is caused to bend upwardly and the other downwardly, thus producing a large torsional moment to be carried across between the side beam sections by the lower connecting section of the stiffleg. By careful design of the side beam sections of the stiffleg, the upward and downward deflection of the I-beam sections can be made sufficient to allow a lateral movement of the dipper equal to about 3% of the length of the structure, without incurring unduly high stresses.

As a result of the use of side beams on the stiffleg having I-shaped cross-sectional configurations, and the omission of any heavy cross-pieces between the side beams except for a single cross-piece section at the lower ends of the side beam sections, the torsional deflection of the stiffleg under a given load is increased to a value which is comparable to that of a resilient joint as employed in the prior art for cushioning torsional loads, thereby eliminating the necessity of such a resilient joint which results in a more economical and efficient front end assembly. Furthermore, because the stiffleg of the present invention is allowed to roll on its own axis, only a single crowd link is required, which may be provided with ball joint connections with the hoist frame and the upper end of the mast.

While the present invention has been described in the context of a particular type of power shovel herein, it is to be understood that the invention can be used in a power shovel having a front end assembly of any configuration which utilizes a stiffleg.

From the foregoing detailed description, it will be evident that there are a number of changes, adaptations and modifications of the present invention which fall within the province of those persons having ordinary skill in the art to which the present invention pertains. However, it is intended that all such variations not departing from the spirit of the invention be considered as within the scope thereof as limited solely by the appended claims.

I claim:

1. In a power shovel comprising a support unit, a stiffleg pivotally connected to said support unit, a dipper handle pivotally connected to the stiffleg, a dipper mounted on the dipper handle and means for, respectively, crowding, retracting and hoisting the dipper, an improved stiffleg construction requiring no resilient joints, but substantially eliminating the transmission of torsional loads to said support unit, and without the use of a plurality of cross-pieces, comprising:

a pair of transversely spaced, longitudinally disposed side beams, each having an I-shaped cross-sectional configuration including upper and lower flange portions and an interconnecting web portion, a unitary web section interconnecting the web portions of said side beams, a cross-piece section interconnecting said side beam sections at ends thereof adjacent the point at which said stiffleg is pivotally connected to said support unit to thereby form said stiffleg into a U-shaped member, bracket means connected to said cross-piece section for pivotally connecting said stiffleg to said support unit and means for pivotally connecting said dipper handle to said stiffleg.

2. The improved stiffleg according to claim 1 including means disposed on said cross-piece section for connecting fluid actuated rod and cylinder assemblies operatively connectable to a dipper handle.

3. The improved stiffleg according to claim 2 wherein said cross-piece section consists of a box beam member.

4. The improved stiffleg according to claim 1 wherein said bracket means includes a pair of said brackets disposed in longitudinal alignment with the web portions of said side beam sections.

5. The improved stiffleg according to claim 1 including means disposed on said cross-piece section for connecting a pair of fluid-actuated rod and cylinder assemblies connectable to a dipper handle, disposed in longitudinal alignment with said bracket means.

6. A stiffleg according to claim 1 wherein said cross-piece section includes upper and lower plate portions merging with the flange portions of said side beam sections.

7. A stiffleg according to claim 1 including means disposed on said side beam sections for journalling a head shaft.

* * * * *